US008205640B2

(12) United States Patent
Kawamura et al.

(10) Patent No.: US 8,205,640 B2
(45) Date of Patent: Jun. 26, 2012

(54) CHECK VALVE, FLUID DEVICE, AND PUMP

(75) Inventors: Kenichiro Kawamura, Kyoto (JP); Masayuki Miyamoto, Kyoto (JP); Takahiro Yamaguchi, Omihachiman (JP); Hidekazu Sasai, Moriyama (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 123 days.

(21) Appl. No.: 12/710,436

(22) Filed: Feb. 23, 2010

(65) Prior Publication Data

US 2010/0215522 A1 Aug. 26, 2010

(30) Foreign Application Priority Data

Feb. 24, 2009 (JP) ..... 2009-041375
Feb. 12, 2010 (JP) ..... 2010-028343

(51) Int. Cl.
*F16K 15/14* (2006.01)

(52) U.S. Cl. ..... 137/854; 137/516.25

(58) Field of Classification Search ..... 137/843, 137/854, 856, 516.25; 251/64
See application file for complete search history.

(56) References Cited

U.S. PATENT DOCUMENTS 4,712,583 A * 12/1987 Pelmulder et al. ..... 137/852
6,089,271 A * 7/2000 Tani ..... 137/854

FOREIGN PATENT DOCUMENTS

| | | | |
|---|---|---|---|
| JP | 2-245482 | A | 10/1990 |
| JP | 6-137445 | A | 5/1994 |
| JP | 10-299922 | A | 11/1998 |
| JP | 11-218244 | A | 8/1999 |
| JP | 2001-73953 | A | 3/2001 |
| JP | 2004-169748 | A | 6/2004 |
| JP | 2008-303951 | A | 12/2008 |

OTHER PUBLICATIONS

JPO translation of JP2004169748, inventor Kakizawa Goro, publication date Jun. 17, 2004.*

* cited by examiner

*Primary Examiner* — Kevin Lee
*Assistant Examiner* — Macade Brown
(74) *Attorney, Agent, or Firm* — Keating & Bennett, LLP

(57) ABSTRACT

A check valve is housed in a valve chamber and includes a support portion and a flexible portion. The support portion extends along a principal axis thereof. The flexible portion is supported by the support portion in a manner extending from the principal axis. A diaphragm defines a lower wall of the valve chamber, and includes an inflow port for fluid at a position that is closed with the flexible portion when the flexible portion is displaced. A bottom plate defines an upper wall of the valve chamber, and faces the diaphragm with the flexible portion arranged therebetween. An uneven portion is provided in at least one of mutually facing areas of an upper principal surface, which is one of two principal surfaces of the flexible portion and faces the bottom plate, and a lower principal surface of the bottom plate, the uneven portion being partially uneven.

8 Claims, 7 Drawing Sheets

CHECK VALVE, FLUID DEVICE, AND PUMP

BACKGROUND OF THE INVENTION

1. Field of the Invention

The present invention relates to a check valve provided in a channel to prevent backflow of fluid from occurring, a fluid device including the check valve housed in a valve chamber, and a pump including the check valve and the valve chamber in a channel communicating with a pump chamber.

2. Description of the Related Art

A piezoelectric pump is used as a fuel transport pump for a fuel cell. The piezoelectric pump pumps fluid in a pump chamber by vibrating a diaphragm with a piezoelectric vibrator. A channel communicating with the pump chamber is provided with a check valve that prevents backflow of fluid from occurring (see, for example, Japanese Unexamined Patent Application Publication No. 2-245482). The check valve includes a support portion and a flexible portion. When pumping is performed while an inflow pressure is less than an outflow pressure and when pumping is stopped, the flexible portion closes the channel. Also, when pumping is performed while the inflow pressure is greater than the outflow pressure, the flexible portion is bent and causes the channel to be open.

In the channel provided with the check valve, when an unexpected change occurs during pumping the fluid, the flexible portion of the check valve may be bent to a greater extent than a predetermined level. For example, when a liquid having bubbles is pumped, the bubbles that are compressed at a high pressure are expanded because the pressure is released when the liquid passes the check valve. The flexible portion of the check valve may be bent to a large extent by the force of the expansion. Also, when high-pressure gas passes the check valve after the liquid is pumped, the flexible portion of the check valve may be bent to a large extent.

The flexible portion of the check valve can be restored even if the flexible portion is bent to a certain level. However, if the flexible portion is bent to a greater extent than the predetermined level, in some cases, the flexible portion may stick to a wall and close the channel at an abnormal position that is different from a normal position, at which the check valve normally closes the channel. For example, when a check valve made of silicone rubber is used, when fluid such as methanol is pumped, the surface of the check valve becomes highly viscous, and thus, the surface is likely to stick to the wall. Thus, the bending state of the flexible portion sticking at the abnormal position may not be restored. Also, when the check valve sticks at the abnormal position similar to a suction cup, the bending state of the flexible portion may not be restored.

If the flexible portion sticks at the abnormal position as described above, the function of the piezoelectric pump may be stopped. Also, if the flexible portion sticks at the abnormal position and closes the channel, a fluid pressure from the outside may exceed a withstanding pressure, possibly resulting in the piezoelectric pump being broken.

SUMMARY OF THE INVENTION

To overcome the problems described above, preferred embodiments of the present invention provide a check valve, a fluid device, and a pump that prevents breakage of the check valve from occurring even if a pumping state of fluid is unintentionally changed.

A check valve according to a preferred embodiment of the present invention includes a support portion and a flexible portion. The support portion is substantially columnar. The flexible portion is supported by the support portion in an inclined manner with respect to a principal axis of the support portion. The check valve includes an uneven portion provided at a principal surface, which is one of two principal surfaces of the flexible portion inclined to the principal axis and which defines an obtuse angle with respect to the support portion, the uneven portion being partially uneven.

To close an inflow port for fluid with the flexible portion of the check valve, a first principal surface at an acute angle to the support portion of the flexible portion must be arranged to face the inflow port for the fluid. Thus, if the flexible portion of the check valve is bent to a large extent, the second principal surface at an obtuse angle to the support portion of the flexible portion may contact the wall. As a result, by providing the uneven portion at the second principal surface, even if the second principal surface of the flexible portion contacts the wall, the contact area therebetween is relatively small. The flexible portion of the check valve is prevented from sticking to the wall.

A fluid device according to another preferred embodiment of the present invention includes a check valve and a valve chamber. The check valve includes a support portion and a flexible portion. The support portion has a substantially columnar shape. The flexible portion is supported by the support portion so as to extend from a principal axis of the support portion. The flexible portion is disposed between first and second walls of the valve chamber. The first wall includes an inflow port for fluid at a position that is closed with the flexible portion when the flexible portion is displaced. The second wall faces the first wall, and includes an outflow port for the fluid. The fluid device includes an uneven portion provided in at least one of mutually facing areas of a principal surface, which is one of two principal surfaces of the flexible portion and faces the second wall, and the second wall of the valve chamber, the uneven portion being partially uneven.

With this configuration, even if the flexible portion of the check valve is bent to a large extent and contacts the second wall, the contact area is relatively small because of the uneven portion. The flexible portion of the check valve can be prevented from sticking to the wall.

The flexible portion may preferably be supported by the support portion at a central portion of the support portion. The uneven portion may preferably be partially uneven along a circumferential edge portion of the flexible portion. The circumferential edge portion of the flexible portion includes the circumferential edge and an area near the circumferential edge.

With this configuration, the flexible portion is supported by the support portion at the central portion of the support portion. The peripheral edge portion can be easily bent. Thus, if the peripheral edge portion of the flexible portion is bent to a large extent and contacts the second wall, the check valve may function as a suction cup, and stick to the second wall. However, since the uneven portion is partially uneven along the circumferential edge portion of the flexible portion, a gap is provided between the second wall and the flexible portion. The check valve no longer functions as a suction cup. When the uneven portion is provided at the flexible portion, if the uneven portion is arranged to contact the circumferential edge of the flexible portion, the flexible portion may become slightly bent, and a pressure loss of a fluid pressure may be increased. Thus, the uneven portion may preferably be located at a position spaced from the circumferential edge of the flexible portion.

The second wall of the valve chamber may preferably have the outflow port for the fluid at a position that is closed with the flexible portion when the flexible portion is displaced. The uneven portion may preferably be provided at a position close to the circumferential edge portion of the flexible portion with respect to the outflow port in the second wall.

With this configuration, since the outflow port for the fluid is provided in the second wall at the position that is closed with the flexible portion when the flexible portion is displaced, the size of the valve chamber can be decreased. However, in this case, the check valve may close the outflow port. In particular, if a very high fluid pressure occurs and a gap between the flexible portion and the second wall because of the uneven portion is pressed, the check valve may function as a suction cup and stick to the second wall, which may result in the outflow port being closed. Thus, the configuration in which the uneven portion is provided at the position close to the circumferential edge portion of the flexible portion with respect to the outflow port in the second wall is used. The check valve does not stick to the wall and the outflow port is prevented from being closed.

A principal surface, which is one of two principal surfaces of the flexible portion and faces the first wall, may preferably define an acute angle to the support portion. Accordingly, the contact area between this surface of the flexible portion and the first wall can be relatively small. Then, a fluid pressure required to open the inflow port from the state in which the check valve closes the inflow port is reduced, and a pressure loss due to the flexible portion is decreased.

A corner portion defined by the support portion and the principal surface, which is the other of the two principal surfaces of the flexible portion and faces the first wall, may preferably be a step. Accordingly, a space is provided at a position near the boundary between the support portion and the flexible portion even if the flexible portion is bent to a large extent. Thus, the flexible portion does not entirely contact the first wall. Also, the amount of deformation of the flexible portion can be decreased at the position at which the flexible portion extends from the support portion.

An upper end of the support portion may preferably contact the second wall and may be supported thereby, and the step provided at the corner portion, which is defined by the support portion and the principal surface being one of two principal surfaces of the flexible portion and facing the first wall may preferably make contact with the first wall and may be supported thereby. In this case, even if a high pressure acts from the outside of the valve chamber, the check valve can be prevented from collapsing, and the check valve can be reliably deformed. As a result, a highly reliable fluid device can be provided.

A pump according to still another preferred embodiment of the present invention includes the aforementioned fluid device, a pump chamber, and a channel communicating with the pump chamber. The valve chamber and the check valve of the fluid device are provided in the channel.

With this configuration, the flexible portion is not bent to a large extent and the uneven portion prevents the flexible portion of the check valve from contacting and sticking to the second wall. Thus, a problem can be prevented from occurring in the check valve provided in the channel of the pump chamber.

With any of the preferred embodiments described above, even if the flexible portion contacts the wall of the valve chamber, the wall which is opposite to the wall including the inflow port, the contact area is relatively small because of the uneven portion. Accordingly, the check valve can be prevented from sticking to the wall.

Other features, elements, characteristics and advantages of the present invention will become more apparent from the following detailed description of preferred embodiments of the present invention with reference to the attached drawings.

DETAILED DESCRIPTION OF PREFERRED EMBODIMENTS

A check valve, a fluid device, and a pump will be described below by using, for example, a piezoelectric pump according to preferred embodiments of the present invention.

Figure 1:
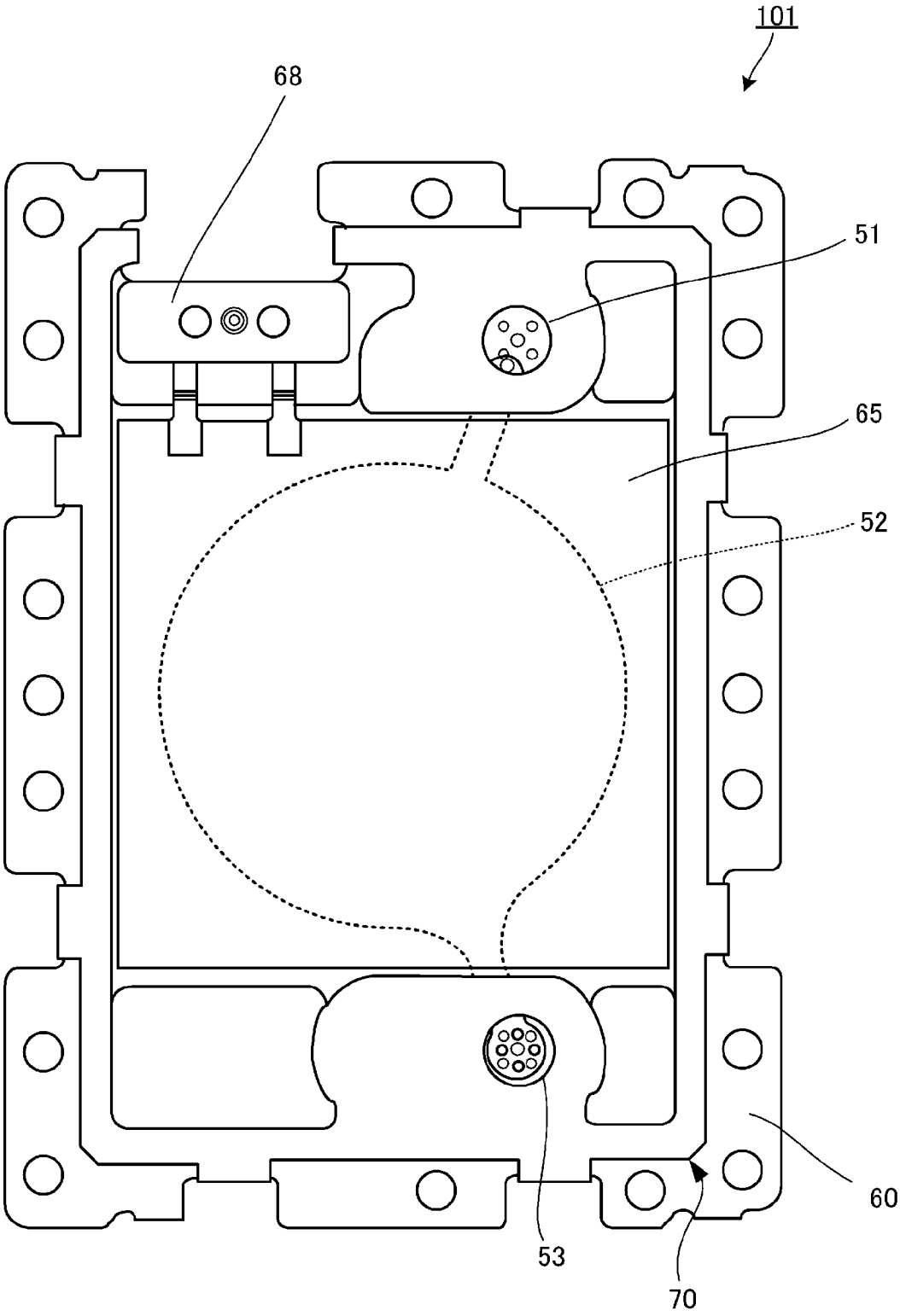
FIG. 1 is a plan view showing a piezoelectric pump according to a preferred embodiment of the present invention.

FIG. 1 is a plan view showing a piezoelectric pump 101 according to a preferred embodiment of the present invention.

The piezoelectric pump 101 includes a connector 68, a piezoelectric vibrator 65, a pump chamber body 70, and a pump chamber top plate 60. The pump chamber body 70 is mounted on the pump chamber top plate 60. The piezoelectric vibrator 65 is mounted on the pump chamber body 70. The pump chamber body 70 includes a pump chamber 52, an inflow channel 51, and an outflow channel 53. The inflow channel 51 supplies the pump chamber 52 with fluid. The outflow channel 53 discharges fluid from the pump chamber 52. The connector 68 is electrically connected to two electrodes of the piezoelectric vibrator 65. The piezoelectric vibrator 65 bends and vibrates when an alternating voltage is applied thereto via the connector 68, to cause the volume of the pump chamber 52 to be repeatedly expanded and contracted. Accordingly, the fluid flows through the inflow channel 51 into the piezoelectric pump 101 when the pump chamber is expanded, and the fluid is discharged from the piezoelectric pump 101 through the outflow channel 53 when the pump chamber 52 is contracted.

Figure 2:
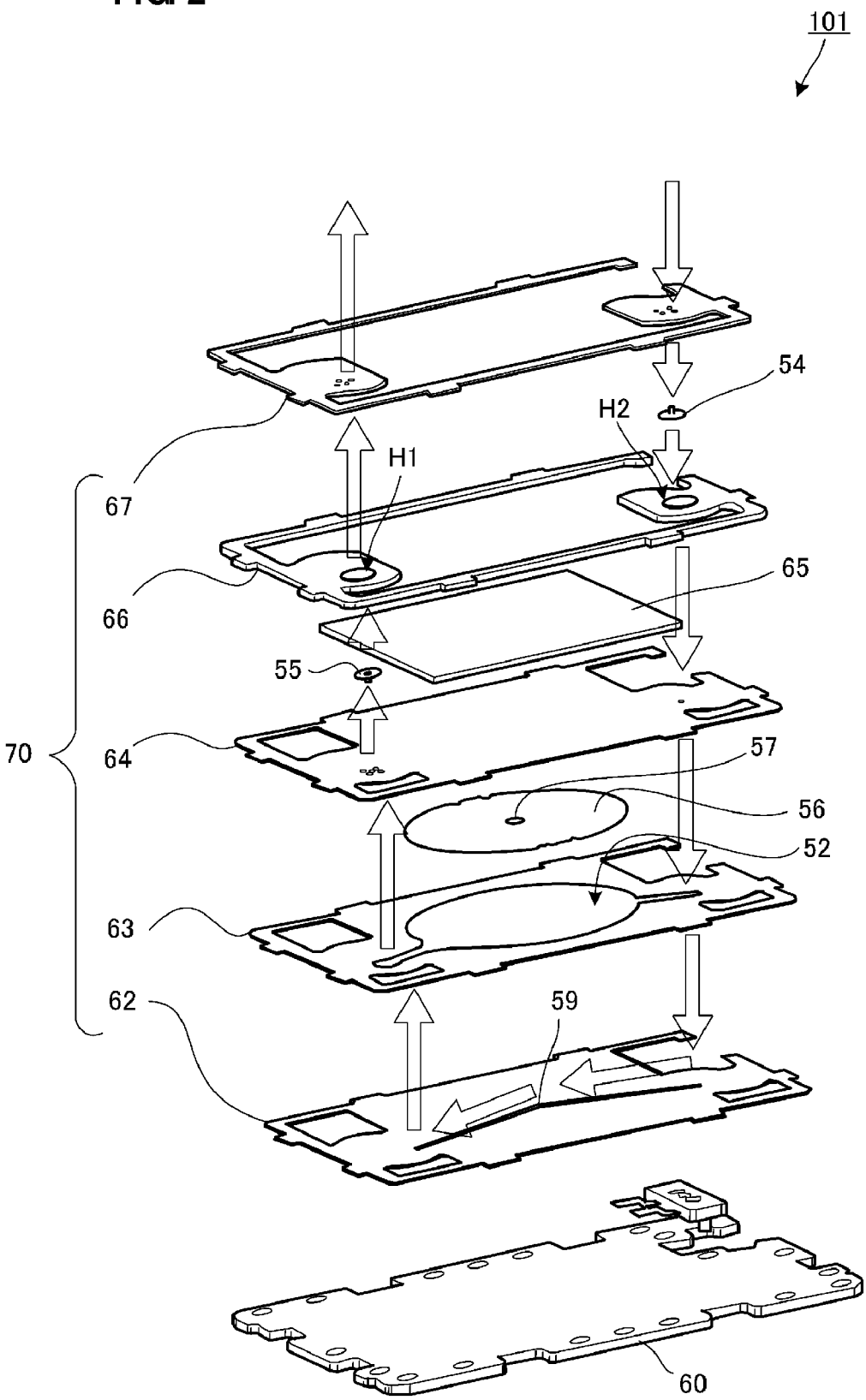
FIG. 2 is an exploded perspective view showing the piezoelectric pump shown in FIG. 1.

FIG. 2 is an exploded perspective view of the piezoelectric pump 101.

The pump chamber body 70 includes a channel plate 62, a pump chamber plate 63, a diaphragm 64, a valve chamber plate 66, and a bottom plate 67 are laminated. The channel plate 62, the pump chamber plate 63, the diaphragm 64, the valve chamber plate 66, and the bottom plate 67 that are preferably made of polyethylene terephthalate (PET) sheets, for example.

The pump chamber body 70 is laminated on the pump chamber top plate 60. The channel plate 62 that defines the pump chamber body 70 is arranged on the pump chamber top plate 60. The channel plate 62 includes a channel groove 59. The channel groove 59 is formed by cutting out a portion from the PET sheet, the portion extending from a formation position of the inflow channel 51 through a central position of the pump chamber 52 to a formation position of the outflow channel 53. The pump chamber plate 63 is arranged on the channel plate 62. The pump chamber plate 63 includes the pump chamber 52. The pump chamber 52 is formed by cutting out a portion from the PET sheet, the portion having a substantial disk shape. A liquid holding member 56 is arranged in the pump chamber 52 in an unfixed manner. The liquid holding member 56 is preferably made of a PET sheet, for example, having a substantial disk shape that is smaller than the pump chamber 52. The liquid holding member 56 includes an opening 57 provided at the central portion of the PET sheet. The liquid holding member 56 holds liquid in a gap between the liquid holding member 56 and the pump chamber 52 by capillary action. The diaphragm 64 is arranged on the pump chamber 52. The piezoelectric vibrator 65 is attached to the diaphragm 64. The piezoelectric vibrator 65 is preferably a rectangular thin plate made of lead zirconate titanate (PZT), for example. The piezoelectric vibrator 65 bends and vibrates and causes the diaphragm 64 to be bent, thereby causing the volume of the pump chamber 52 to be repeatedly expanded and contracted. The valve chamber plate 66 is arranged on the diaphragm 64. The valve chamber plate 66 includes an opening, in which the piezoelectric vibrator 65 is disposed, and two valve chambers H1 and H2. The valve chamber H2 is provided at the inflow channel 51, and includes a check valve 54 arranged therein. The check valve 54 prevents backflow of the fluid from occurring in the inflow channel 51. The valve chamber H1 is provided at the outflow channel 53, and includes a check valve 55 arranged therein. The check valve 55 prevents backflow of the fluid from occurring in the outflow channel 53. The bottom plate 67 is arranged on the valve chamber plate 66.

To use the piezoelectric pump 101, the piezoelectric pump 101 is arranged such that the pump chamber top plate 60 is located at the upper side and the bottom plate 67 is located at the lower side. Thus, the components located in the bottom layer and the top layer are called the "pump chamber top plate" and the "bottom plate" in FIGS. 3A and 3B for ease of description. Of course, the piezoelectric pump 101 may be arranged such that the pump chamber top plate 60 is located at the lower side and the bottom plate 67 is located at the upper side.

Figure 3A:
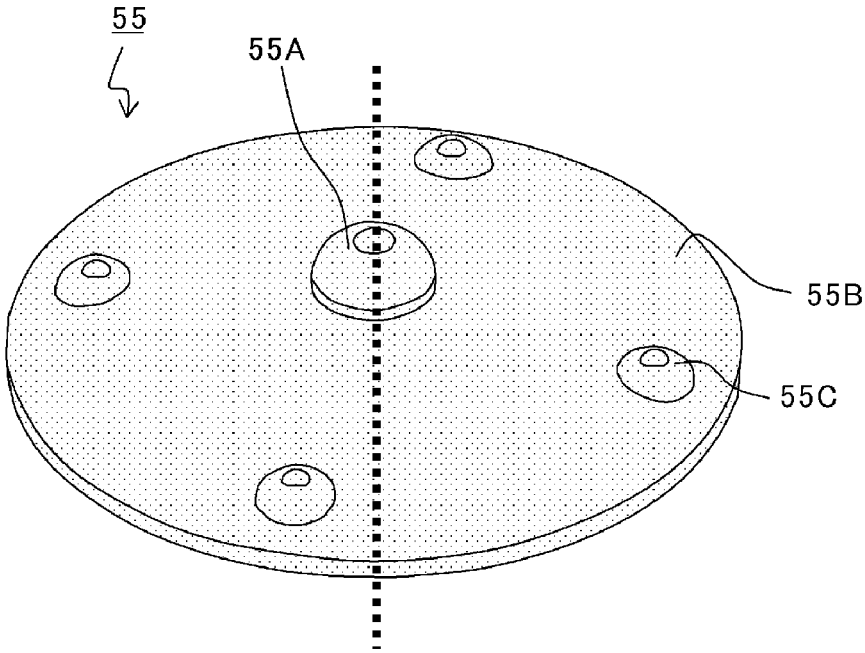
FIGS. 3A and 3B illustrate configurations of a valve chamber and a check valve shown in FIG. 2.
Figure 3B:
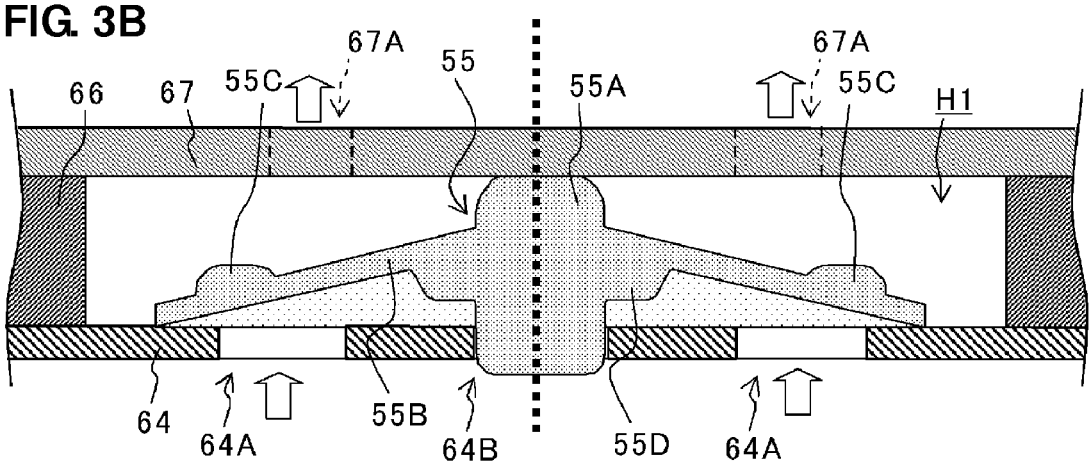

FIGS. 3A and 3B illustrate configurations of the check valve 55 and the valve chamber H1 in the piezoelectric pump 101. FIG. 3A is a perspective view of the check valve 55. FIG. 3B is a cross-sectional view of the valve chamber H1 in which the check valve 55 is disposed. Although the description of the check valve 54 and the valve chamber H2 will be omitted, the configurations of the check valve 54 and the valve chamber H2 are substantially the same as those of the check valve 55 and the valve chamber H1 except that the arrangement is upside down.

The check valve 55 is preferably integrally formed of silicone rubber, for example, and includes a support portion 55A, a flexible portion 55B, and four uneven portions 55C. Since the check valve 55 is preferably made of the silicone rubber, for example, the check valve 55 can be molded into a complicated shape. The support portion 55A preferably has a substantially columnar shape, for example. In this preferred embodiment, the support portion 55A preferably has a substantially columnar shape with edge portions rounded, for example. The principal axis of the support portion 55A is indicated by a dotted line in the drawing.

The flexible portion 55B is supported by the support portion 55A at a position near the central portion of the support portion 55A in an inclined manner to the principal axis of the support portion 55A. In this preferred embodiment, the flexible portion 55B preferably has a substantially circular shape around the principal axis of the support portion 55A as the central axis, for example. The upper principal surface of the flexible portion 55B preferably has a substantial umbrella shape, for example, that defines an obtuse angle to the support portion 55A. The lower principal surface of the flexible portion 55B preferably has a substantial funnel shape, for example, that defines an acute angle to the support portion 55A. The flexible portion 55B is displaced in accordance with a fluid pressure. Here, the upper end of the support portion 55A protrudes from the upper principle surface of the flexible portion 55B. Accordingly, the angle defined by the support portion 55A and the flexible portion 55B, which extends from the support portion 55A, approaches a right angle. Thus, the flexible portion 55B is easily bent. With this configuration, the fluid pressure required to open inflow ports 64A can be decreased, and a pressure loss due to the flexible portion 55B can be decreased.

A step 55D is provided at a position at which the lower principal surface of the flexible portion 55B extends from the support portion 55A. The step 55D extend substantially vertically from the lower principal surface of the flexible portion 55B, and also extends from the peripheral surface of the support portion 55A. The step 55D determines a range within which the check valve 55 can be retracted downward when a high fluid pressure acts on the upper principal surface of the flexible portion 55B. Also, even when the check valve 55 is retracted downward, a space is provided at a position near the boundary between the flexible portion 55B and the step 55D. Accordingly, since the step 55D is provided, the principal surface of the flexible portion 55B does not entirely stick to the lower wall of the valve chamber H1. Also, since the step 55D is provided, the deformation amount of the flexible portion 55B in an area near the position at which the flexible portion 55B extends from the support portion 55A can be decreased. Thus, the flexible portion 55B is not excessively bent.

The four uneven portions 55C are provided at the upper principal surface of the flexible portion 55B. The four uneven portions 55C are preferably arranged at substantially equal intervals along the circumferential edge of the flexible portion 55B, for example. Each of the uneven portions 55C protrudes from the upper principal surface of the flexible portion 55B and preferably has a substantially circular shape, for example. Here, the uneven portions 55C are provided at positions spaced from the circumferential edge of the flexible portion 55B. Accordingly, the flexible portion 55B can be easily bent as compared to a case in which the uneven portions 55C are in contact with the circumferential edge. With this configuration, the fluid pressure required to open an inflow port 64A can be decreased, and a pressure loss due to the flexible portion 55B can be decreased.

The valve chamber H1 is a substantially columnar space surrounded by the diaphragm 64, the valve chamber plate 66, and the bottom plate 67. The valve chamber H1 houses the check valve 55 therein. The diaphragm 64 defines the lower wall of the valve chamber H1, and includes the inflow ports 64A and a support opening 64B of the valve chamber H1. The support opening 64B is provided at the central portion of the valve chamber H1. The inflow ports 64A are provided at positions, so as to face the flexible portion 55B of the check valve 55. The lower wall of the valve chamber H1 corresponds to a first wall. The bottom plate 67 defines the upper wall of the valve chamber H1, and includes outflow ports 67A (for example, four outflow ports 67A) of the valve chamber H1. The outflow ports 67A are provided at positions close to the inner circumference side with respect to the uneven portions 55C of the flexible portion 55B, so as to face the flexible portion 55B. That is, the uneven portions 55C are provided at the positions close to the circumferential edge of the flexible portion 55B with respect to the outflow ports 67A. The upper wall of the valve chamber H1 corresponds to a second wall. The valve chamber plate 66 defines the side wall of the valve chamber H1.

A lower end portion of the support portion 55A of the check valve 55 is inserted into the support opening 64B of the valve chamber H1. The upper end of the support portion 55A contacts the bottom plate 67 and is supported thereby. A lower portion of the circumferential edge of the flexible portion 55B contacts the diaphragm 64 and is supported thereby. Accordingly, the position of the check valve 55 is regulated in a horizontal plane, and the position of the check valve 55 is regulated at the principal axis. In this preferred embodiment, a distance from the upper wall to the lower wall of the valve chamber H1 is slightly less than a distance from the upper end of the support portion 55A to the lower end of the flexible portion 55B of the check valve 55, so that the check valve 55 is pinched by the upper and lower walls of the valve chamber H1. As described above, since the check valve 55 is pinched by the upper and lower walls of the valve chamber H1, the position of the check valve 55 can be precisely regulated while the height of the fluid device including the check valve 55 and the valve chamber H1 is decreased.

Also, in this preferred embodiment, since the flexible portion 55B is inclined to the principal axis of the support portion 55A, only the portion near the circumferential edge of the flexible portion 55B contacts the diaphragm 64. Accordingly, the contact area between the flexible portion 55B and the diaphragm 64 is relatively small, a fluid pressure required to open the inflow ports 64A can be decreased, and a pressure loss due to the flexible portion 55B can be decreased.

When the pump chamber 52 is contracted, the fluid pressure acting on the lower principal surface of the flexible portion 55B becomes greater than the fluid pressure acting on the upper principal surface. The circumferential edge portion of the flexible portion 55B is bent upward, and thus, the lower space located below the check valve 55 and communicating with the inflow ports 64A is open. Accordingly, the fluid flows forward in the valve chamber H1. In contrast, when the pump chamber 52 is expanded, the fluid pressure acting on the lower principal surface of the flexible portion 55B becomes less than the fluid pressure acting on the upper principal surface. The upward bending state of the flexible portion 55B is restored, and thus, the flexible portion 55B is pressed to the lower wall of the valve chamber H1. Accordingly, the lower space located below the check valve 55 and communicating with the inflow ports 64A is closed, and the backflow of the fluid in the valve chamber H1 is prevented from occurring.

With the check valve 55 and the valve chamber H1 of the above-described configuration, similar to the configuration of related art, the flexible portion 55B is bent upward to a greater extent than a predetermined level when the fluid pressure acting on the lower principal surface of the flexible portion 55B is greater than the fluid pressure acting on the upper principal surface. Thus, the uneven portions 55C contact the upper wall of the valve chamber H1.

Figure 4:
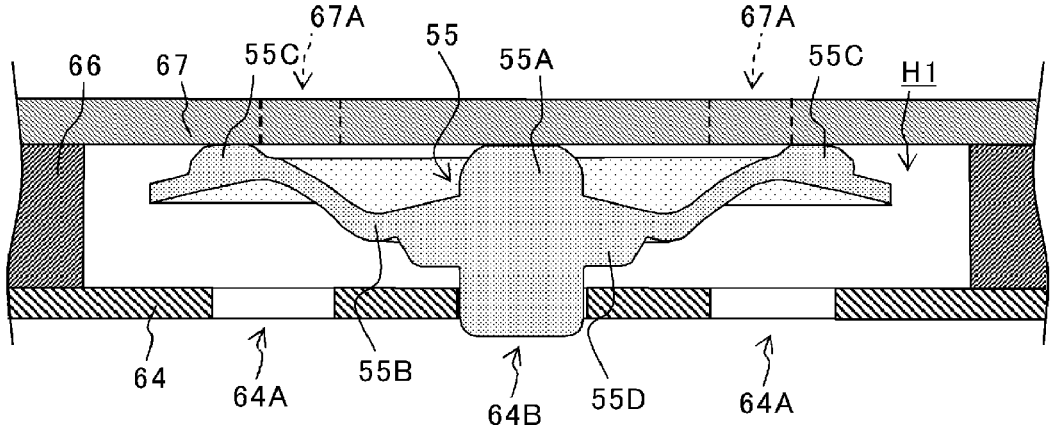
FIG. 4 illustrates the check valve shown in FIG. 2 when the check valve is deformed.

FIG. 4 is a cross-sectional view showing a deformed state of the check valve 55. When the flexible portion 55B is bent upward to a greater extent than the predetermined level and the uneven portions 55C contact the upper wall of the valve chamber H1, the uneven portions 55C contact areas located close to the outer circumference with respect to the outflow ports 67A. Accordingly, a gap is provided between the upper principal surface of the flexible portion 55B and the upper wall of the valve chamber H1. Accordingly, the contact area between the check valve 55 and the upper wall of the valve chamber H1 is relatively small, and the flexible portion 55B does not function as a suction cup. The flexible portion 55B does not stick to the upper wall of the valve chamber H1. Thus, when the pumping state of the fluid is restored to the normal state, the bending state of the flexible portion 55B is restored.

Due to this, in the piezoelectric pump 101, even if liquid including bubbles is pumped or high-pressure gas flows after liquid is pumped, and thus, if the flexible portion of the check valve is bent to a large extent, the function of the piezoelectric pump is not stopped, the flexible portion does not close the outflow ports, and the piezoelectric pump is not broken. Thus, the piezoelectric pump 101 is highly reliable.

Each of the uneven portions 55C is not necessarily a protrusion, and may be a recess, for example, as long as the contact area between the uneven portion 55C and the upper wall of the valve chamber H1 is relatively small. In particular, a configuration is preferable in which the uneven portions 55C can contact the upper wall of the valve chamber H1 by point contact or line contact. The number of the uneven portions 55C is not particularly limited, as long as at least one uneven portion 55C is provided. The flexible portion 55B does not have to be substantially circular and may be substantially rectangular, for example. The flexible portion 55B may have a substantial tongue shape that is supported by the support portion 55A at a position offset from the center. The flexible portion 55B may be configured such that the lower principal surface of the flexible portion 55B entirely contacts the lower wall of the valve chamber H1 having the inflow ports. Further, as shown in FIG. 3 of Japanese Unexamined Patent Application Publication No. 2-245482, a check valve 55 may be supported such that a large-diameter portion is provided at an end of a support portion and upper and lower surfaces of a wall of a valve chamber are pinched by the large-diameter portion and a flexible portion. With any of these configurations, the preferred embodiments of the present invention can preferably be used by providing the uneven portion 55C on the principal surface of the flexible portion 55B facing the second wall.

Alternatively, the uneven portion 55C may have a substantial ring shape surrounding the support portion 55A, for example. Even in this case, the contact area between the check valve 55 and the upper wall of the valve chamber H1 is relatively small. However, in this case, it is difficult to prevent the check valve 55 in an excessively bending state from sticking to the upper wall like a suction cup. In such a case, a cut line may preferably be provided in a portion of the substantial ring shape, or a cut line may preferably be provided in a portion of the upper wall, for example, so that a pressure in the suction cup is released.

Next, a check valve, a fluid device, and a pump will be described using, for example, a piezoelectric pump according to another preferred embodiment of the present invention.

Figure 5A:
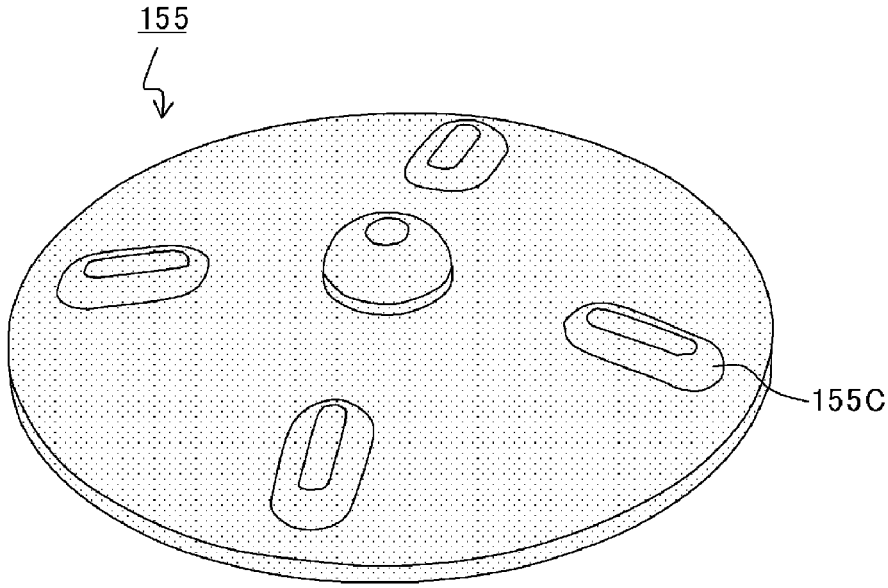
FIGS. 5A and 5B illustrate exemplary configurations of check valves according to another preferred embodiment of the present invention.
Figure 5B:
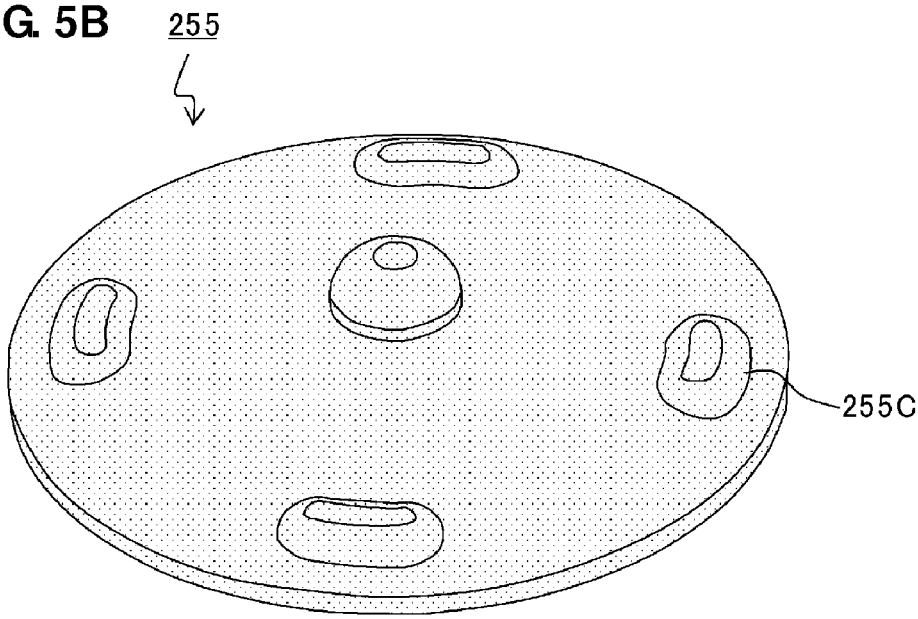

FIGS. 5A and 5B are perspective views showing exemplary configurations of check valves.

A check valve 155 shown in FIG. 5A includes uneven portions 155C each having a shape different from that of the check valve 55. Each of the uneven portions 155C protrudes from the substantial umbrella shaped upper principal surface of the check valve 155 and preferably has a substantially elongated circular shape, for example. The major axis of the elongated circular shape extends along the diameter of the check valve 155. Alternatively, a check valve 255 shown in FIG. 5B includes uneven portions 255C each having a shape different from that of the check valve 55. Each of the uneven portions 255C protrudes from the substantial umbrella-shaped upper principal surface of the check valve 255 and preferably has a substantially elongated circular shape, for example. The major axis of the elongated circular shape extends along the circumference of the check valve 255. As described above, the uneven portion may have any suitable shape. For example, recesses and protrusions may be provided on the entire surface of the flexible portion.

Figure 6A:
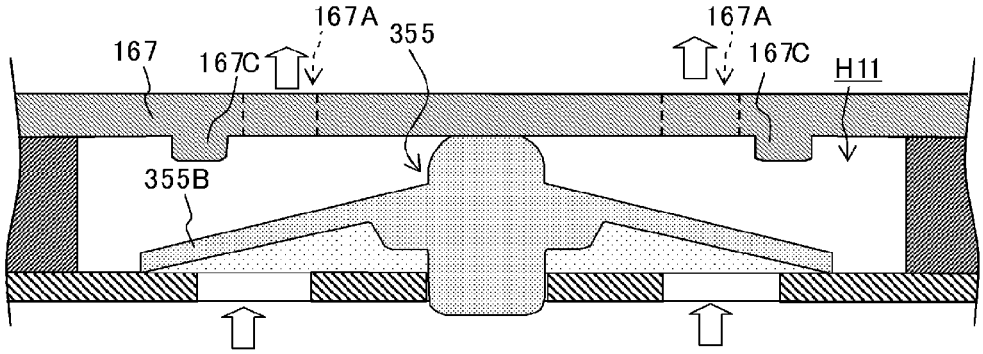
FIGS. 6A to 6C illustrate exemplary configurations of valve chambers and check valves according to another preferred embodiment of the present invention.
Figure 6B:
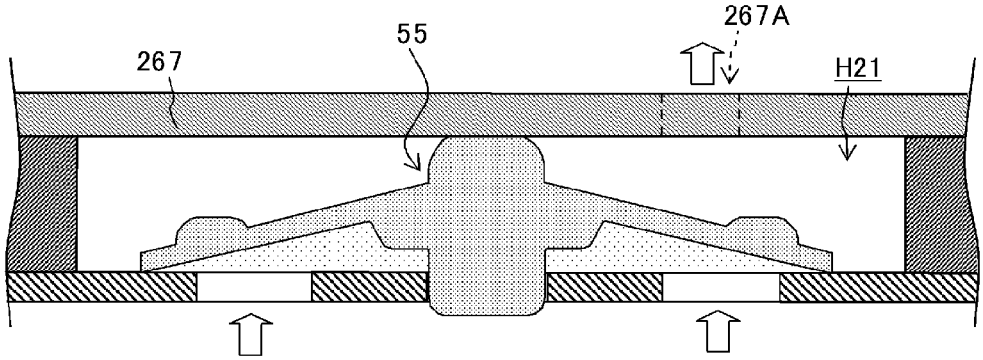

FIGS. 6A and 6B are cross-sectional views showing exemplary configurations of check valves according to various preferred embodiments of the present invention.

In the example including a check valve 355 and a valve chamber H11 shown in FIG. 6A, uneven portions 167C are provided at positions different from the positions in a preferred embodiment including the check valve 55 and the valve chamber H1. In particular, the substantial umbrella shaped upper principal surface of a flexible portion 355B of the check valve 355 preferably has a continuous surface without a recess or a protrusion, and the uneven portions 167C are provided on the lower surface of a bottom plate 167 that defines the upper wall of the valve chamber H11, so as to face the flexible portion 355B.

In this configuration, when the flexible portion 355B is bent upward to a greater extent than a predetermined level, the flexible portion 355B contacts the uneven portions 167C. Accordingly, a gap is provided between the upper principal surface of the flexible portion 355B and the upper wall of the valve chamber H11. Thus, the contact area between the check valve 355 and the upper wall of the valve chamber H11 is relatively small, and the flexible portion 355B does not function as a suction cup. The flexible portion 355B does not stick to the upper wall of the valve chamber H11. Thus, when the pumping state is restored to the normal state, the bending state of the flexible portion 355B is restored.

Each of the uneven portions 167C may preferably be formed by roughening the area of the upper wall of the valve chamber H11 facing the flexible portion 355B, for example. The number of the uneven portions 167C is not particularly limited, as long as at least one uneven portion 167C is provided. With any of the configurations, the preferred embodiments of the present invention can preferably be used by providing the uneven portion on the second wall.

In the example including a check valve 55 and a valve chamber H21 shown in FIG. 6B, the number of outflow ports is different from the number of the outflow ports in the valve chamber H1. In particular, three of the four outflow ports are eliminated, and only one outflow port 267A is provided. In this configuration, the bending state of the flexible portion 55B in an area directly below the outflow port 267A is greater than the bending state of the flexible portion 55B in the other areas. As described above, by arranging the formation position of the outflow port at a deflected position in a specific direction in the area in which the outflow port faces the flexible portion, the bending force can be differentiated merely by using the single check valve. As a result, even if the portion of the flexible portion 55B located close to the outflow port 267A sticks, the residual portion of the flexible portion 55B does not stick. The sticking portion of the flexible portion 55B can be easily separated from the upper wall of the valve chamber H21 while the residual portion of the flexible portion 55B functions as a separation start point. As a result, the flexible portion 55B does not function as a suction cup, and thus, the flexible portion 55B does not stick to the upper wall of the valve chamber H21. In this configuration, the single outflow port 267A is provided. Alternatively, two or more outflow ports may be provided as long as the formation positions of the outflow ports are deflected in the area in which the flexible portion faces the outflow ports.

Figure 6C:
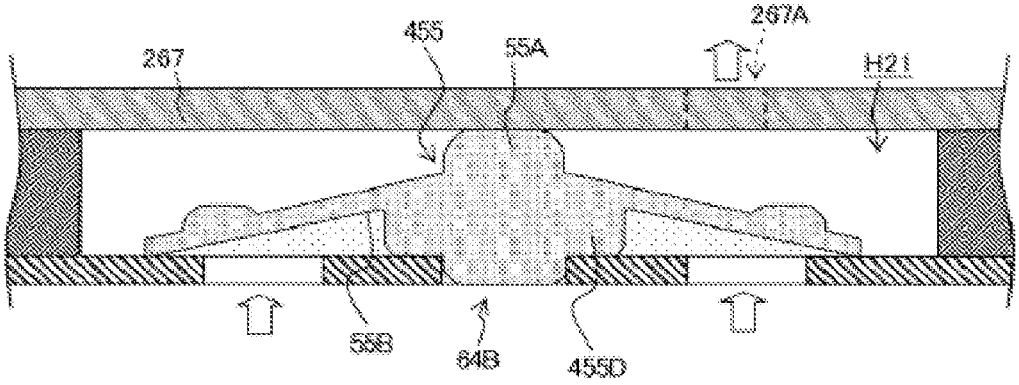

In an example including a check valve 455 and a valve chamber H21 shown in FIG. 6C, a step 455D provided at a support portion 55A contacts a lower wall of the valve chamber H21 and is supported thereby. The step of the check valve 455 is pinched by the upper and lower walls of the valve chamber H21. Thus, even if the check valve 455 receives a high pressure from the upper wall of the valve chamber H21 and the check valve 455 is pushed into a support opening 64B, the deformation of check valve 455 is prevented, and the posture of the check valve 455 does not become unstable. Also, the posture of the check valve 455 is not collapsed by an external factor, such as vibration or a drop test, for example. Thus, a highly reliable fluid device can be provided.

Next, the results of a performance validation test for a piezoelectric pump will be described. In the test, a pressure was measured when the check valve 55 was excessively bent in the valve chamber H21 and was sticking to the wall of the valve chamber. A check valve having a related art configuration which does not include an uneven portion was provided for comparison in the performance validation test. The performance of the check valve 55 according to a preferred embodiment of the present invention was compared to the performance of the check valve 355 of the related art.

Figure 7A:
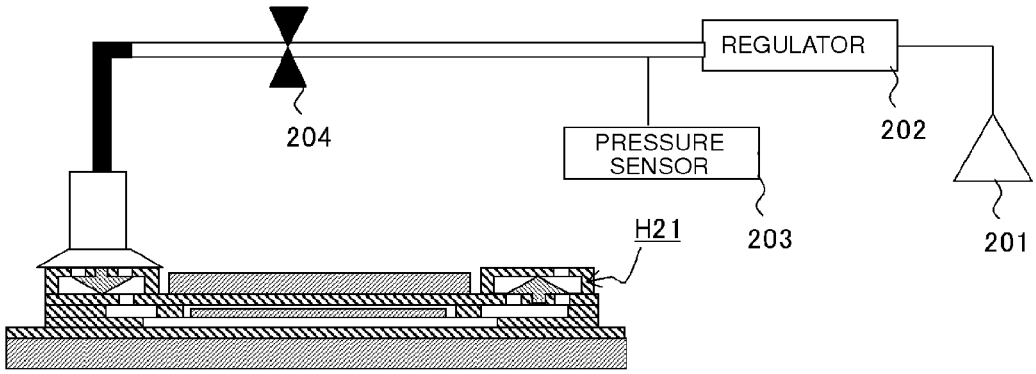
FIGS. 7A to 7C illustrate an overview of a performance validation test.
Figure 7B:
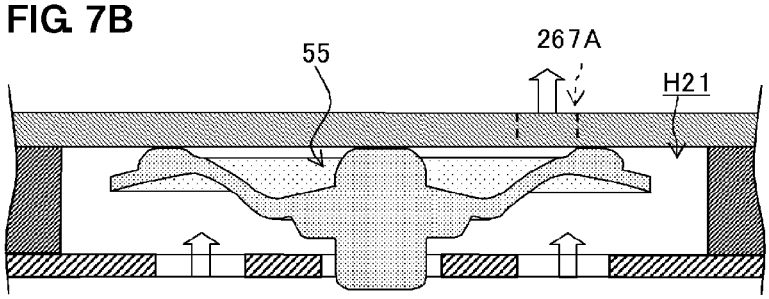
Figure 7C:
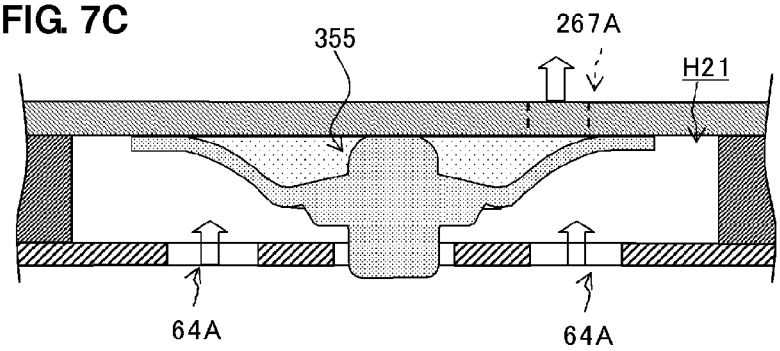

FIG. 7A illustrates an experimental environment for the performance validation test. FIG. 7B illustrates a state in which the check valve 55 is bent to a large extent. FIG. 7C illustrates a state in which the check valve 355 is bent to a large extent.

An experimental device used for this experiment includes a regulator 202, a high-pressure source 201, a pressure sensor 203, and a cock 204 connected to a pumping pipe that is connected to an inflow channel of the piezoelectric pump.

In the test, first, the piezoelectric pump was filled with methanol. Next, the regulator 202 was adjusted while the cock 204 was closed, and the pressure sensor 203 detected a predetermined pressure. Then, the cock 204 was opened to cause air to flow into the piezoelectric pump. It was determined whether it was visually recognizable that the check valve was excessively bent in the valve chamber and stuck to the wall of the valve chamber H21.

The experiment was repeated and the predetermined pressure was changed by 10 kPa each time. As a result, the check valve 55 did not stick at a pressure higher than 100 kPa. During the experiment, the check valve 55 was excessively bent as shown in FIG. 7B. However, after the experiment, the excessively bending state of the check valve 55 was restored, and the normal operation could be performed. In contrast, in the comparative configuration, at the predetermined pressures from about 30 kPa to about 50 kPa, sticking of the check valve 355 frequently occurred. The check valve 355 was excessively bent as shown in FIG. 7C continuously even after the experiment, and the normal operation could not be performed. The results of the performance validation test verify that the check valve according to preferred embodiments of the present invention effectively prevented sticking.

While preferred embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. A check valve comprising:

a support portion;

a flexible portion including two principal surfaces and supported by the support portion in an inclined manner relative to a principal axis of the support portion; and an uneven portion arranged at a position spaced away from a circumferential edge of the flexible portion and provided on one of the two principal surfaces of the flexible portion inclined relative to the principal axis and defining an obtuse angle to the support portion; wherein no uneven portions are provided at the circumferential edge of the flexible portion.

2. A fluid device comprising:

a check valve including a support portion and a flexible portion including two principal surfaces and supported by the support portion in an inclined manner relative to a principal axis of the support portion;

a valve chamber including first and second walls and housing the flexible portion between the first and second walls, the first wall having an inflow port for fluid at a position that is closed by the flexible portion when the flexible portion is not displaced, the second wall facing the first wall and having an outflow port for the fluid at a position that is closed by the flexible portion when the flexible portion is displaced; and an uneven portion arranged at a position spaced away from a circumferential edge of the flexible portion and provided in at least one of one of the two principal surfaces of the flexible portion inclined relative to the principal axis and defining an obtuse angle to the support portion and that faces the first wall and the second wall of the valve chamber: wherein no uneven portions are provided at the circumferential edge of the flexible portion.

3. The fluid device according to claim 2, wherein the flexible portion is supported by the support portion at a central portion of the support portion; and the uneven portion is partially uneven at the position spaced away from the circumferential edge of the flexible portion.

4. The fluid device according to claim 2, wherein the second wall of the valve chamber includes the outflow port for the fluid at a position that is closed with the flexible portion when the flexible portion is displaced; and the uneven portion is provided at a position close to the edge portion of the flexible portion with respect to the outflow port.

5. The fluid device according to claim 2, wherein the other of the two principal surfaces of the flexible portion that faces the first wall defines an acute angle to the support portion.

6. The fluid device according to claim 5, wherein a corner portion defined by the support portion and the other principal surface of the flexible portion and faces the first wall includes a step.

7. The fluid device according to claim 6, wherein an upper end of the support portion is arranged to contact the second wall and is supported thereby, and the step included at the corner portion is arranged to contact the first wall and is supported thereby.

8. A pump comprising:

a fluid device including:

a check valve including a support portion and a flexible portion including two principal surfaces and supported by the support portion in an inclined manner relative to a principal axis of the support portion;

a valve chamber including first and second walls and housing the flexible portion between the first and second walls, the first wall having an inflow port for fluid at a position that is closed by the flexible portion when the flexible portion is not displaced, the second wall facing the first wall and having an outflow port for the fluid at a position that is closed by the flexible portion when the flexible portion is displaced; and an uneven portion arranged at a position spaced away from a circumferential edge portion of the flexible portion and provided in at least one of one of the two principal surfaces of the flexible portion inclined relative to the principal axis and defining an obtuse angle to the support portion and that faces the first wall and the second wall of the valve chamber; wherein no uneven portions are provided at the circumferential edge portion of the flexible portion;

a pump chamber; and a channel arranged to communicate with the pump chamber; wherein the valve chamber and the check valve of the fluid device are provided in the channel.

* * * * *